US005351661A

United States Patent [19]

Doll

[11] Patent Number: 5,351,661

[45] Date of Patent: Oct. 4, 1994

[54] MULTI-CYLINDER INTERNAL COMBUSTION ENGINE VALVE ACTUATOR

[75] Inventor: Gerhard Doll, Stuttgart, Fed. Rep. of Germany

[73] Assignee: Mercedes-Benz AG, Fed. Rep. of Germany

[21] Appl. No.: 63,711

[22] Filed: May 21, 1993

[30] Foreign Application Priority Data

Jun. 27, 1992 [DE] Fed. Rep. of Germany ..... 4221135

[51] Int. Cl.[5] ..... F01L 1/34

[52] U.S. Cl. ..... 123/90.16; 123/90.44

[58] Field of Search ..... 123/90.15, 90.16, 90.17, 123/90.39, 90.44

[56] References Cited

U.S. PATENT DOCUMENTS

| | | | |
|---|---|---|---|
| 4,576,128 | 3/1986 | Kenichi | 123/90.16 |
| 4,726,332 | 2/1988 | Nishimura et al. | 123/90.16 |
| 4,768,475 | 9/1988 | Ikemura | 123/90.16 |
| 4,901,685 | 2/1990 | Fukuo et al. | 123/90.16 |
| 4,911,112 | 3/1990 | Oikawa et al. | 123/90.16 |
| 4,926,804 | 5/1990 | Fukuo | 123/90.16 |

FOREIGN PATENT DOCUMENTS

| | | |
|---|---|---|
| 0342007 | 11/1989 | European Pat. Off. . |
| 3445951 | 6/1985 | Fed. Rep. of Germany . |
| 2185784 | 7/1987 | United Kingdom . |

*Primary Examiner*—E. Rollings Cross
*Assistant Examiner*—Weilun Lo
*Attorney, Agent, or Firm*—Evenson, McKeown, Edwards & Lenahan

[57] ABSTRACT

In an apparatus for valve actuation in a multi-cylinder internal combustion engine, a valve is actuated by two actuation levers which can be coupled together by coupling elements. The actuation levers are driven by two cams with different cam protrusions. In order to avoid wear-causing incomplete coupling for all the coupling elements when the cam protrusions become effective, their triggering for coupling and decoupling only takes place within an interval of time fixed with respect to the camshaft position. When the cam protrusions become effective, the coupling or decoupling procedure is either concluded or at least a sufficient overlap of the coupling elements is produced.

9 Claims, 3 Drawing Sheets

MULTI-CYLINDER INTERNAL COMBUSTION ENGINE VALVE ACTUATOR

BACKGROUND OF THE INVENTION

The present invention relates to an apparatus for valve actuation in a multi-cylinder internal combustion engine, and, more particularly, to a valve actuator in an engine having, per cylinder, an actuation lever driving a valve and driven by a first camshaft cam which includes a cam protrusion and a base circle, and a coupling lever driven by a second camshaft cam which includes a cam protrusion and a base circle. The levers are supported on a common lever pin so as to be pivotable relative to one another and can be connected together by a coupling apparatus comprising a first coupling element applied to one of the levers and a second adjustable coupling element applied to the other lever and acting in the coupled condition on the first coupling element, with the second coupling element being triggered for adjustment thereof.

DE 34 45 951 C2 describes a known actuator in which adjustment of the adjustable coupling element at an undesired time is prevented by an additional control lever which acts on the coupling apparatus. This apparatus is expensive, heavy, subject to wear, and requires additional installation space.

An object of the present invention is to provide an apparatus for valve actuation which prevents initiation of a coupling procedure or decoupling procedure at an undesired time or period, without additional weight and installation space occurring or considerable complication having to be incurred.

This object has been achieved in an apparatus in accordance with the present invention by providing that the adjustable coupling elements are triggered within a setting range of the camshaft which is predetermined so that the coupling elements of each coupling apparatus have at least a predetermined limiting overlap or are completely decoupled at a time when a cam protrusion associated with the coupling apparatus becomes effective.

In the apparatus according to the present invention, the common triggering of all the coupling apparatuses within a narrowly limited setting range of the camshaft reliably prevents the coupling apparatus associated with a cam protrusion from carrying out only a small part of the coupling procedure or from having substantially completed the decoupling procedure at the time when the cam protrusion becomes effective. Because the coupling apparatus is subject to considerable forces when the associated cam protrusion subsequently becomes effective, which forces prevent completion of the coupling or decoupling procedure, edge pressures and excessive surface contact pressures can occur in this coupling condition with little overlap between the coupling elements. This leads to wear and damage to the coupling elements or, if the coupling is cancelled under load, to the levers and cams.

The apparatus of the present invention ensures that mutually independent coupling conditions with unfavorably slight overlap of the coupling elements are avoided during both the coupling procedure and the decoupling procedure.

According to one embodiment of the coupling apparatus, a dimension for the overlap of the coupling elements which reliably prevents, on one hand, excessive loading on the coupling elements or the ejection of the movable coupling element and, on the other hand, limits the undesired period for the beginning of a coupling procedure such that sufficient time remains to ensure that the coupling procedure begins outside the undesired period even in the case of a multi-cylinder internal combustion engine and the higher rotational speeds of this internal combustion engine which are decisive for the coupling.

A type of triggering of the adjustable coupling elements which can be carried out by the present invention in a simple manner and permits the expectation of adequate timing accuracy. This is made more precise by another aspect of the present invention in which the duration of the triggering range of the coupling elements is determined exclusively by the switching time variance of the switching valve, whereas the triggering of the switching valve can be fixed by the use of an electrical signal at a certain time, i.e. practically without triggering time variance.

The configuration of the valve actuator of the apparatus in accordance with the present invention takes account of different coupling speeds of the adjustable coupling element during the coupling procedure due to different viscosities, and therefore flow speeds, of the hydraulic medium due to different temperatures so that the limiting overlap is reliably achieved within the desired times even under these changed boundary conditions.

The configuration of the apparatus in accordance with the present invention also permits the periods permissible for the triggering of the coupling apparatus in the case of multi-cylinder internal combustion engines to be extended or, if these periods remain unchanged, the configuration makes it possible to increase the rotational speed of the internal combustion engine which is decisive for a coupling procedure.

BRIEF DESCRIPTION OF THE DRAWINGS

These and further objects, features and advantages of the present invention will become more apparent from the following detailed description when taken in conjunction with the accompanying drawings wherein.

DETAILED DESCRIPTION OF THE DRAWINGS

Figure 1:
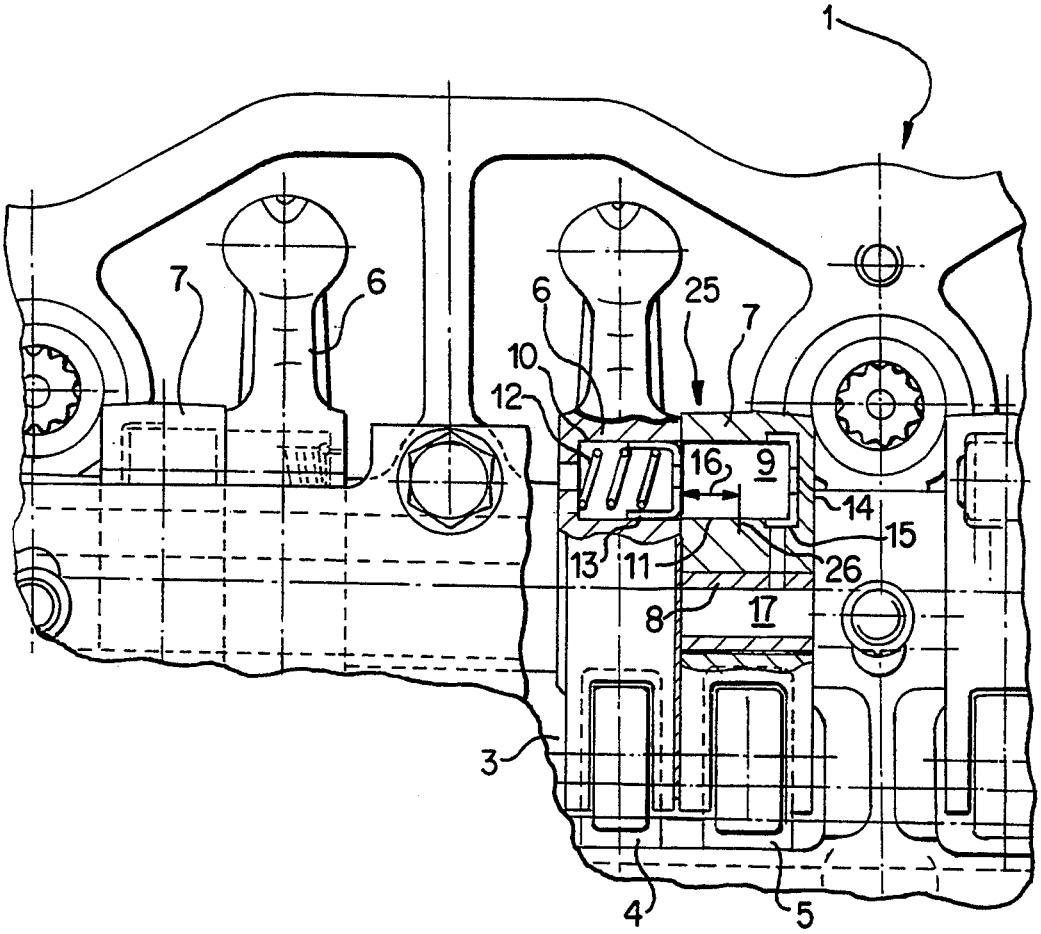
FIG. 1 is a partial sectional plan view of a multi-cylinder internal combustion engine with actuation levers and coupling levers for the valve drive with coupling apparatus in accordance with the present invention.
Figure 2:
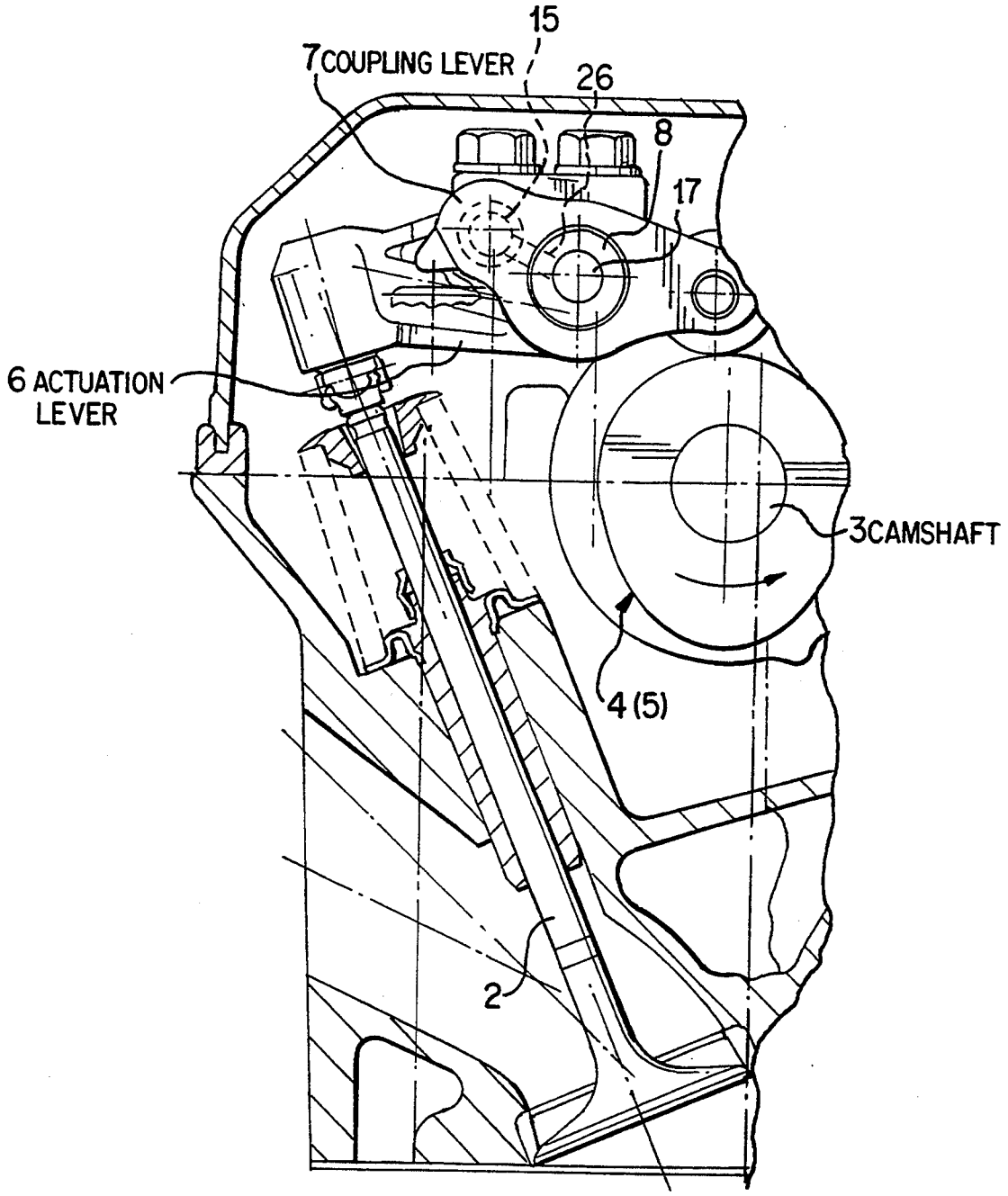
FIG. 2 is a partial cross-sectional transverse view of the internal combustion engine of FIG. 1.

Two inlet valves 2 per cylinder are supported in the cylinder head 1 of a multi-cylinder reciprocating piston of a known internal combustion engine. For clarity, the engine is not shown in greater detail. The inlet valves are driven by a camshaft 3. Two cams 4, 5 on the camshaft 3 are associated with each inlet valve 2, one cam 4 actuating an actuation lever 6, which drives the inlet valve 2 directly and is configured as a rocker arm, and the other cam 5 actuates a coupling lever 7 which can be coupled to the actuation lever 6. The actuation lever 6 and the coupling lever 7 are rotatably supported on a common lever pin 8. The two cams 4, 5 have base circles of the same diameter whereas the cam 5 associated with the coupling lever 7 has a larger cam protrusion than the cam 4 associated with the actuation lever 6 so that in the coupled condition of the two levers 6, 7, the cam protrusion of the cam 4 is ineffective.

The coupling of the actuation lever 6 and the coupling lever 7 takes place by a coupling apparatus designated generally by numeral 25 which includes a pin 9 and a cylindrical bore hole 10 as the coupling elements. The pin 9 is guided so that it can be displaced longitudinally parallel to the lever pin 8 in a bore hole 11, in the coupling lever 7 and is loaded by a spring 12 via a guide cup 13 which is guided so that it can be displaced longitudinally in the cylindrical hole 10 in the actuation lever 6. The bore hole 10 is aligned with the hole 11 when the two levers 6, 7 are in contact with the respective base circle of the cams 4, 5.

In the decoupled condition, the spring 12 presses the pin 9 against a stop 14 on its end facing away from the actuation lever 6 so that it closes the contact plane between the two levers 6, 7 and does not protrude into the cylindrical hole 10. In order to couple the two levers 6, 7, an oil pressure is generated in a pressure space 15 on the end of the pin 9 facing away from the actuation lever 6. This oil pressure pushes the pin 9 into the cylindrical hole 10 against the force of the spring 12 as far as the stop of the guide cup 13 on the end wall of this cylindrical hole 10 so that a partial length 16 of the pin 10 protrudes into the cylindrical hole 10 and torsionally couples the two levers 6 and 7 together.

The partial length 16 is equal to the distance, in the decoupled condition, of the guide cup 13 from the end wall of the cylindrical hole 10 remote from the coupling lever 7. Because the cam protrusion of the cam 5 associated with the coupling lever 7 is larger than the cam protrusion of the cam 4 associated with the actuation lever 6, the valve lift curve of the inlet valve 2 is now determined by the cam 5. It is apparent that, otherwise than in the illustrated embodiment, the pin 9 can be arranged in the actuation lever 6 and the cylindrical hole 10 can be arranged in the coupling lever 7 and that the coupling can be carried out by pressure relief in the pressure space 15 and the decoupling by pressure build-up in the pressure space 15.

The pin 9 can only be pushed into the cylindrical hole 10 while the base circles of the cams 4, 5 are effective because this cylindrical hole 10 and the hole 11 are not aligned with one another when the cam protrusions are effective. Because considerable forces are transmitted between the levers 6, 7 while the cam protrusions are effective, displacement of the pin 9 inside the cylindrical hole 10 is excluded when the cam protrusions are effective even if the coupling or decoupling procedure has already been initiated by pressure build-up or pressure relief in the pressure space 15. The danger therefore arises that only a small part of the pin 9 may protrude into the cylindrical hole 10 during the total interval of time when the cam protrusions are effective, so that unfavorable edge pressures or excessive surface contact pressures arise or the pin 9 may even be ejected from the cylindrical hole 10; which can cause damage to the levers and cams. It has, however, been found that if at least a third of the partial length 16 of the pin 9 is located in the cylindrical hole 10, excessive loads and damage can be excluded.

Figure 3:
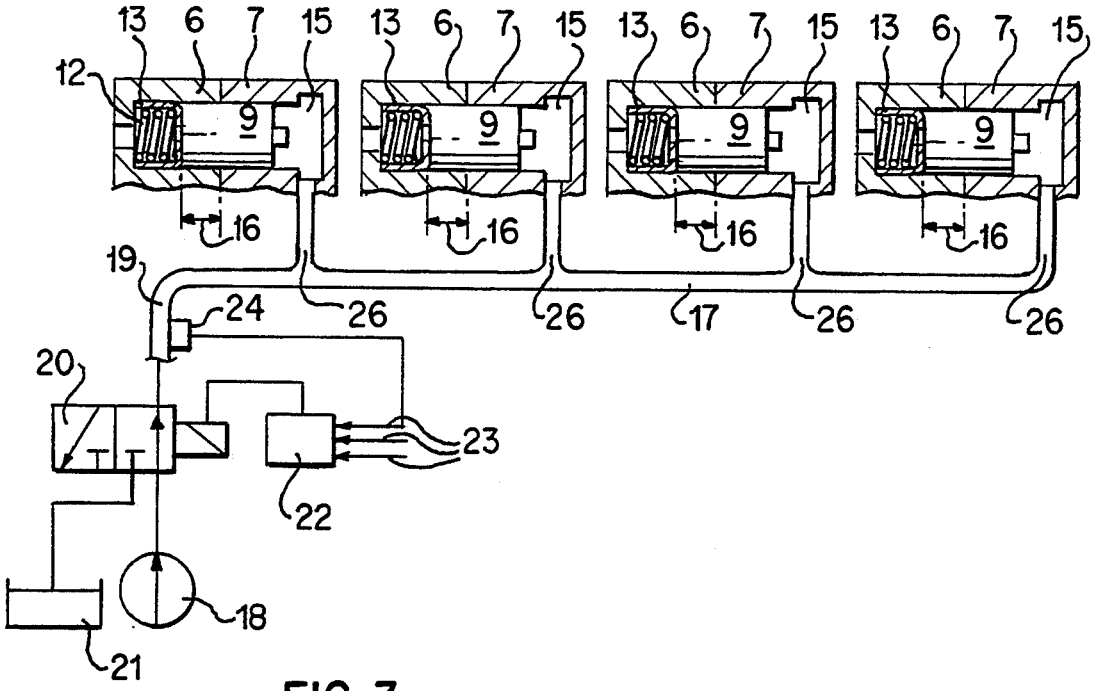
FIG. 3 is a schematic view of a control device for the coupling apparatus shown in FIGS. 1 and 2.

The pressure build-up and reduction in the pressure space 15 takes place via a longitudinal hole 17 in the lever pin 8, which is connected to the pressure space 15 via a transverse hole 26 in the coupling lever 7. The longitudinal hole 17 is supplied with oil via a conduit 19 by an oil pump 18 which can be the usual lubricating oil pump of the internal combustion engine. A 3/2-way valve 20 (FIG. 3) is arranged in conduit 19 to connect the longitudinal hole 17 either to the oil pump 18 or to a reservoir 21. The 3/2-way valve 20 is switched by an electrical signal from a switching unit 22 which receives, as the control signals 23, the internal combustion engine rotational speed, a positional signal of the crankshaft or camshaft of the internal combustion engine and the oil temperature, via a temperature sensor 24 in the conduit 19. The 3/2-way valve 20 can therefore be triggered in quite specific or definite camshaft positions.

The 3/2-way valve 20 is fast-acting and has a very small switching time variance of not more than 4.5 ms, i.e. when the electrical signals coming from the switching unit 22 remain the same, all the switching procedures of the 3/2-way valve 20 take place within an interval of time $T_1$ of 4.5 ms. This ensures that the switching of the 3/2-way valve 20 and, therefore, the start of adjustment of the pin 9 at the beginning of the coupling procedure or decoupling procedure also takes place within this interval of time because, due to the short conduit lengths and the large conduit cross-sections between the 3/2-way valve 20 and the pins 9, there is a negligibly small delay between their actuation times. Because the switching occurs at certain internal combustion engine rotational speeds, the range is also accurately determined with respect to the camshaft position. At an internal combustion engine rotational speed of 4000 rpm and a switching time variance of the 3/2-way valve of 4.5 ms, for example, this range is therefore 54° of camshaft angle.

Figure 4:
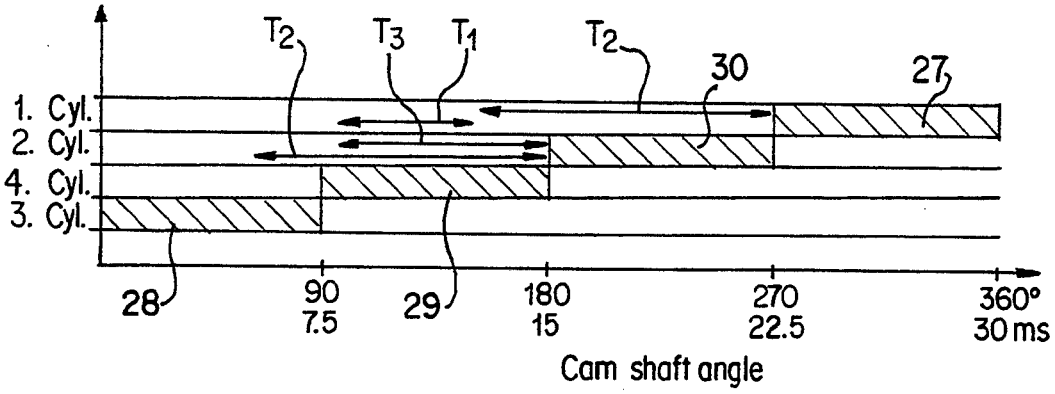
FIG. 4 is a diagrammatic representation with the principles of the present invention applied to a four-cylinder internal combustion engine.

FIG. 4 is a control diagram for a decoupling procedure of the coupling apparatus in a four-cylinder internal combustion engine. The switching rotational speed is assumed to be 4000 rpm so that 360° of camshaft angle corresponds to 30 ms. Considered in a simplified manner, the cam protrusions (regions 27 to 30) associated with the individual cylinders for the inlet valves 2 have an extent of 90° of camshaft angle and follow on from one another continuously. The decoupling procedure lasts longer than the coupling procedure and is therefore more critical than the coupling procedure with respect to exceeding the limiting overlap between the coupling elements. This is because the drive of the pin 9 during the decoupling procedure takes place by way of the weaker spring 12 instead of the oil pressure in the pressure space 15 during the coupling procedure. The illustrated embodiment assumes a total running time $T_2$ of the pin 9 of 10 ms. In order to ensure at least the limiting overlap of the coupling elements at the beginning of each cam protrusion 27 to 30, an actual running time $T_3$ of 7 ms must, as a maximum, have elapsed at this time if the decoupling procedure has not already finished completely. A beginning of movement in an interval of time of less than 10 ms and more than 7 ms before the beginning of each cam protrusion 27 to 30 has, therefore, to be excluded. This is achieved by triggering the coupling apparatus 25 within an interval of time $T_1$ which extends from 7 ms to 2.5 ms before the beginning of the cam protrusion of a cylinder (i.e., the cam protrusion 30 of the second cylinder in the illustrated embodiment). This is possible without difficulty because of the very small switching time variance of the 3/2-way valve. Thereby, the limiting overlap of the coupling elements when the associated cam protrusion becomes effective is still ensured in the coupling apparatus associated with the second cylinder, on one hand, whereas in the other cylinders, the decoupling procedure is reliably concluded when the associated cam protrusions become effective. The interval $T_2$ between the triggering of the coupling apparatus and the beginning of the cam protrusion of the first cylinder, which is the next to follow that of the second cylinder, is therefore the required 10 ms even for the latest possible beginning of the decoupling procedure.

The total running time of the pins 9 can change with changing temperature of the hydraulic oil. A corresponding change to the position of the interval of time $T_1$ can be taken into account by a changed position of the triggering of the 3/2-way valve 20. This is made possible by measuring the oil temperature via the temperature sensor 24 and supplying this temperature to the switching unit.

If the switching times are too short for given switching rotational speeds of the internal combustion engine because of an excessive number of cylinders, it is within the scope of the present invention to form a plurality of groups of cylinders, for example, in the two banks of a V-engine, and to associate each group with a separate apparatus.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A valve actuation apparatus in a multi-cylinder internal combustion engine having, per cylinder, an actuation lever driving a valve and driven by a first cam of a camshaft, said first cam including a cam protrusion and a base circle, and a coupling lever driven by a second cam of the camshaft, said second cam includes a cam protrusion and a base circle, said levers being supported on a common lever pin so as to be pivotable relative to one another and arranged to be connected together by a coupling apparatus comprising a first coupling element being cylindrical hole in one of the levers and a second adjustable coupling element being a pin associated with the other lever, and the pin having a partial length pushed into the hole to complete coupling, the second coupling element being triggered for adjustment thereof, and means are provided for common triggering of all the adjustable coupling elements of the engine within a predetermined setting range of the camshaft so that the coupling elements of each coupling apparatus have at least a predetermined limiting overlap when a cam protrusion associated with any of the coupling apparatus becomes effective, wherein the predetermined limiting overlap is reached when approximately a third of the partial length of the pin is located in the cylindrical hole.

2. The apparatus according to claim 1, wherein the adjustable coupling elements are configured and arranged such that triggering thereof for the coupling procedure and for the decoupling procedure takes place in positional ranges of the camshaft which are different with respect to position and duration.

3. The apparatus according to claim 1, wherein the adjustable coupling elements is configured to be associated with hydraulic pressure so that triggering takes place by a change to the hydraulic pressure acting thereon, and a multi-way valve is arranged in a hydraulic conduit to initiate the hydraulic pressure change via switching of the valve.

4. The apparatus according to claim 3, wherein the adjustable coupling elements are configured and arranged such that triggering thereof for the coupling procedure and for the decoupling procedure takes place in positional ranges of the camshaft which are different with respect to position and duration.

5. The apparatus according to claim 3, wherein the multi-way valve is configured to include a high setting speed and a high level of setting time accuracy with very small setting time variance, the length of which corresponds approximately to the time range within which the triggering of the coupling apparatus takes place.

6. The apparatus according to claim 5, wherein the multi-way valve is configured such that its triggering time is variable as a function of the temperature of the hydraulic medium.

7. The apparatus according to claim 6, wherein the multi-way valve is configured to include a high setting speed and a high level of setting time accuracy with very small setting time variance, the length of which corresponds approximately to the time range within which the triggering of the coupling apparatus takes place.

8. The apparatus according to claim 1, wherein groups of cylinders are formed in different cylinder banks of a V-engine, and a separate apparatus is associated with each group with different setting ranges of the camshaft for the triggering of the associated coupling apparatuses.

9. The apparatus according to claim 8, wherein the adjustable coupling elements are configured and arranged such that triggering thereof for the coupling procedure and for the decoupling procedure takes place in positional ranges of the camshaft which are different with respect to position and duration.

* * * * *